US007021194B2

(12) United States Patent
Shimo et al.

(10) Patent No.: US 7,021,194 B2
(45) Date of Patent: Apr. 4, 2006

(54) SLIDING COMPONENT AND COMPRESSOR

(75) Inventors: Toshihisa Shimo, Kariya (JP); Hitotoshi Murase, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/211,008

(22) Filed: Aug. 2, 2002

(65) Prior Publication Data

US 2003/0024380 A1 Feb. 6, 2003

(30) Foreign Application Priority Data

Aug. 3, 2001 (JP) ..... 2001-235928

(51) Int. Cl.
*F04B 39/00* (2006.01)

(52) U.S. Cl. ..... 92/71

(58) Field of Classification Search ..... 92/12.2, 92/71

See application file for complete search history.

(56) References Cited

U.S. PATENT DOCUMENTS

| | | | | |
|---|---|---|---|---|
| 4,683,804 | A | 8/1987 | Futamura et al. | 92/71 |
| 5,466,737 | A | 11/1995 | Oki et al. | 524/495 |
| 5,947,003 | A * | 9/1999 | Jepsen et al. | 92/71 |
| 6,123,009 | A | 9/2000 | Kanayama et al. | 92/71 |
| 6,183,137 | B1 * | 2/2001 | Kojima et al. | 384/297 |
| 6,582,200 | B1 * | 6/2003 | Kato et al. | 92/71 |
| 6,584,886 | B1 * | 7/2003 | Sugiura et al. | 92/71 |
| 6,589,021 | B1 * | 7/2003 | Kato et al. | 92/71 |

FOREIGN PATENT DOCUMENTS

| | | |
|---|---|---|
| CN | 1215141 | 1/1999 |
| EP | 0 943 800 A1 | 9/1999 |
| EP | 1 035 326 A2 | 9/2000 |
| EP | 1 036 938 A2 | 9/2000 |
| EP | 0 890 743 B1 | 2/2002 |
| JP | 11-13638 | 1/1999 |
| JP | 2000-319472 | 11/2000 |

OTHER PUBLICATIONS

Definitions of Plastic Resins, 1999, The Society of the Plastics Industry. p. 9. http://www.socplas.org/industry/defs.htm.*

Mitsui Chemical Inc., Technical Data Sheet N. 961002; *XP-002263336* (1996), pp. 1-2.

* cited by examiner

*Primary Examiner*—Thomas E. Lazo
(74) *Attorney, Agent, or Firm*—Morgan & Finnegan, LLP

(57) ABSTRACT

A swash plate is operably connected through a lug plate and a hinge mechanism to a drive shaft, and slidably retained on an end part of each piston through a pair of front and rear shoes. A rotational motion of the swash plate following rotation of the drive shaft is converted through the shoes into a reciprocating motion of each piston. A thermoplastic polyimide coating is formed on the swash plate and the shoes as sliding components of a compressor. The thermoplastic polyimide coating may contain a solid lubricant. For the solid lubricant, for example, polytetrafluoroethylene is used. Thus, it is possible to obtain a compressor, which includes the sliding components having improved sliding characteristics, and is manufactured relatively easily.

8 Claims, 2 Drawing Sheets

SLIDING COMPONENT AND COMPRESSOR

BACKGROUND OF THE INVENTION

The present invention relates to a sliding component that is used, for example, in a compressor for an air conditioning system, and to a compressor.

Lubrication of sliding components constituting an internal mechanism of a compressor is normally carried out by forming lubricating oil held in the compressor into mists with a refrigerant gas (e.g., a refrigerant gas of chlorofluorocarbon gas or the like) circulated in the operating compressor, and carrying the oil in the mist form to each sliding portion. However, in the case of restarting the compressor after it has been left unoperated for a long time, the lubricating oil adhered to the sliding portion may be washed away by the refrigerant gas.

For example, in a swash plate compressor, each piston is connected through shoes to a swash plate, and reciprocated in a cylinder bore by rotation or sliding of the swash plate. The swash plate and the shoes are slid before the lubricating oil reaches the sliding surfaces thereof immediately after the compressor is started. Moreover, before the lubricating oil reaches the sliding surfaces of the swash plate and the shoes, a gaseous refrigerant reaches the sliding surfaces and washes the lubricating oil remaining on the sliding surfaces. Accordingly, the swash plate and the shoe are slide under a dry sliding condition of no lubricating oil immediately after the compressor is started.

Therefore, during the period (about one minute) between returning of the refrigerant gas to the compressor and starting of mist formation of the compressor, the sliding portion, which needs lubricating with the compressor in operation, is subjected to a state of inadequate lubrication. Thus, the conventional art has presented technologies for reliably lubricating the sliding portion in such a period of an insufficient lubricating oil quantity.

Examples presented in order to improve sliding characteristics of the swash plate and the like include a method of forming an Ni—P plated film on a sliding surface by electroless plating and a method of forming an Al sprayed film on a surface of a swash plate made of iron. Furthermore, Japanese Laid-Open Patent Publication No. Hei 11-13638 discloses a method of forming a plated layer of tin, copper or the like on a surface of a swash plate made of an iron- or aluminum-based substrate material (i.e., surface slide-contacting a shoe), and forming a slide-contacting layer made of a polyamide-imide resin, and a solid lubricant (molybdenum disulfide, graphite or the like) on the plated layer.

However, the method of forming the Ni—P plated film or the Al sprayed film on the sliding surface of the swash plate has provided no sufficient sliding characteristics. The method of forming the slide-contacting layer made of the polyamide-imide resin and the solid lubricant, disclosed in Japanese Laid-Open Patent Publication No. Hei 11-13638, has provided better sliding characteristics compared with the method of forming the Ni—P plated film, but still not sufficient. Recently, carbon dioxide has attracted attention as a refrigerant of the compressor. However, use of the carbon dioxide as a refrigerant results in a greater increase in a compression load applied on the swash plate through the piston compared with the use of chlorofluorocarbon refrigerant, making a sliding environment severer. Thus, there is a need for improvement of sliding characteristics.

SUMMARY OF THE INVENTION

The present invention was made with the foregoing problems in mind, and a first object of the invention is to provide a sliding component capable of improving sliding characteristics, manufactured relatively easily and suited to a compressor. A second object is to provide a compressor including the sliding component.

To achieve the foregoing and other objectives and in accordance with the purpose of the present invention, the invention provides a sliding component. The sliding component includes a metal body having a sliding surface, and thermoplastic polyimide coating formed on the sliding surface.

The present invention also provides a compressor. The compressor includes a drive shaft, a swash plate supported on the drive shaft, a shoe, and a piston coupled to the swash plate with the shoe. The swash plate coverts rotation of the drive shaft into reciprocation of the piston. The swash plate has a first sliding surface. The shoe has a second sliding surface sliding on the first sliding surface. The shoe has a third sliding surface, which slides on the piston. The piston has a fourth sliding surface, which slides on the third sliding surface. Thermoplastic polyimide coating is formed on at least one of the first to fourth sliding surfaces.

The present invention further provides a method for forming coating on a metal member having a sliding surface. The method includes the steps of adhering thermoplastic polyimide powder onto the sliding surface, baking the sliding surface, on which the powder is adhered, to melt the powder, and quenching the baked sliding surface to form thermoplastic polyimide coating on the sliding surface.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Next, a variable displacement swash plate type compressor according to the present invention will now be described with reference to FIGS. 1 and 2.

Figure 1:
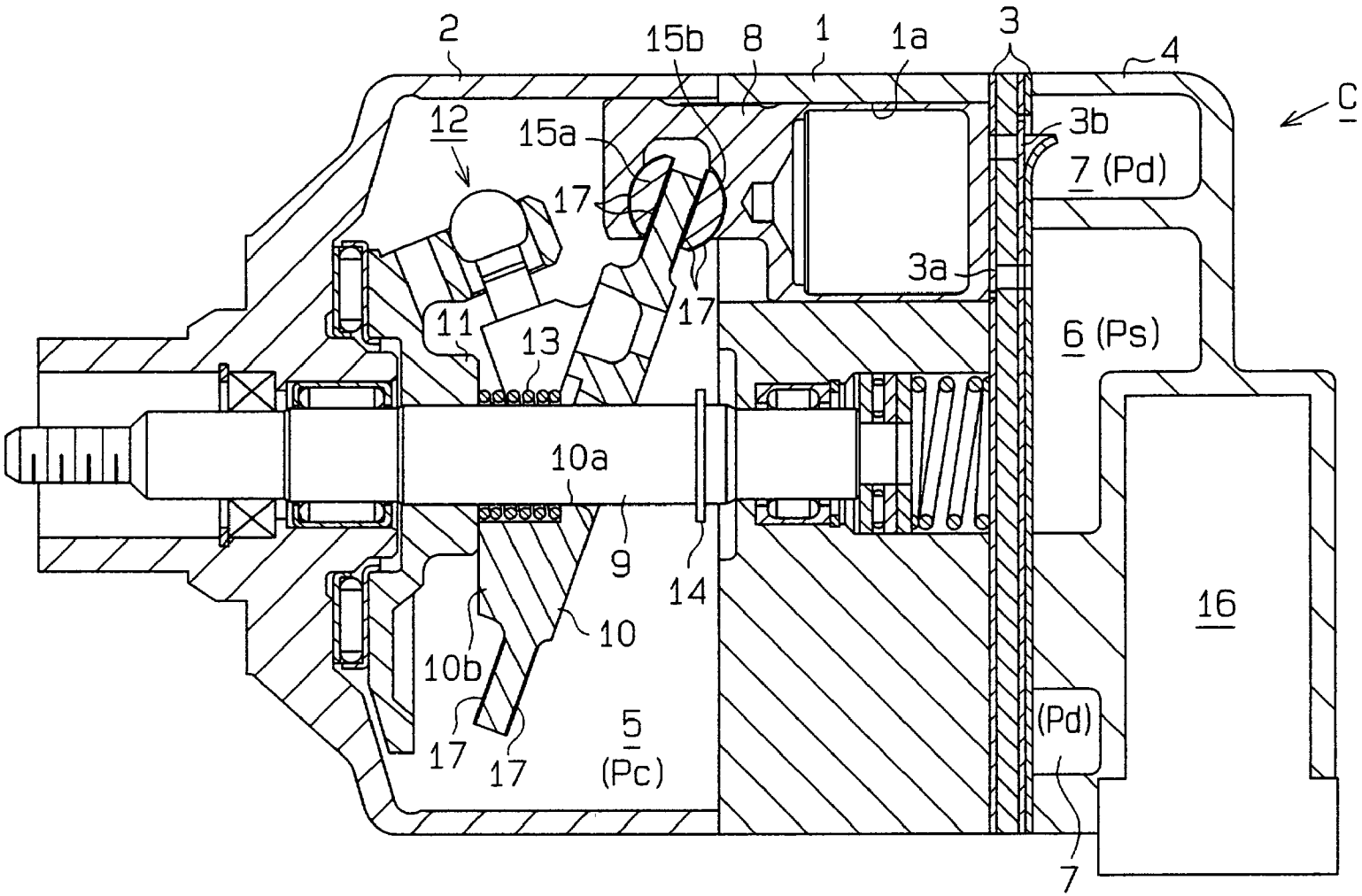
FIG. 1 is a cross-sectional view illustrating a compressor according to one embodiment of the present invention.
Figure 2:
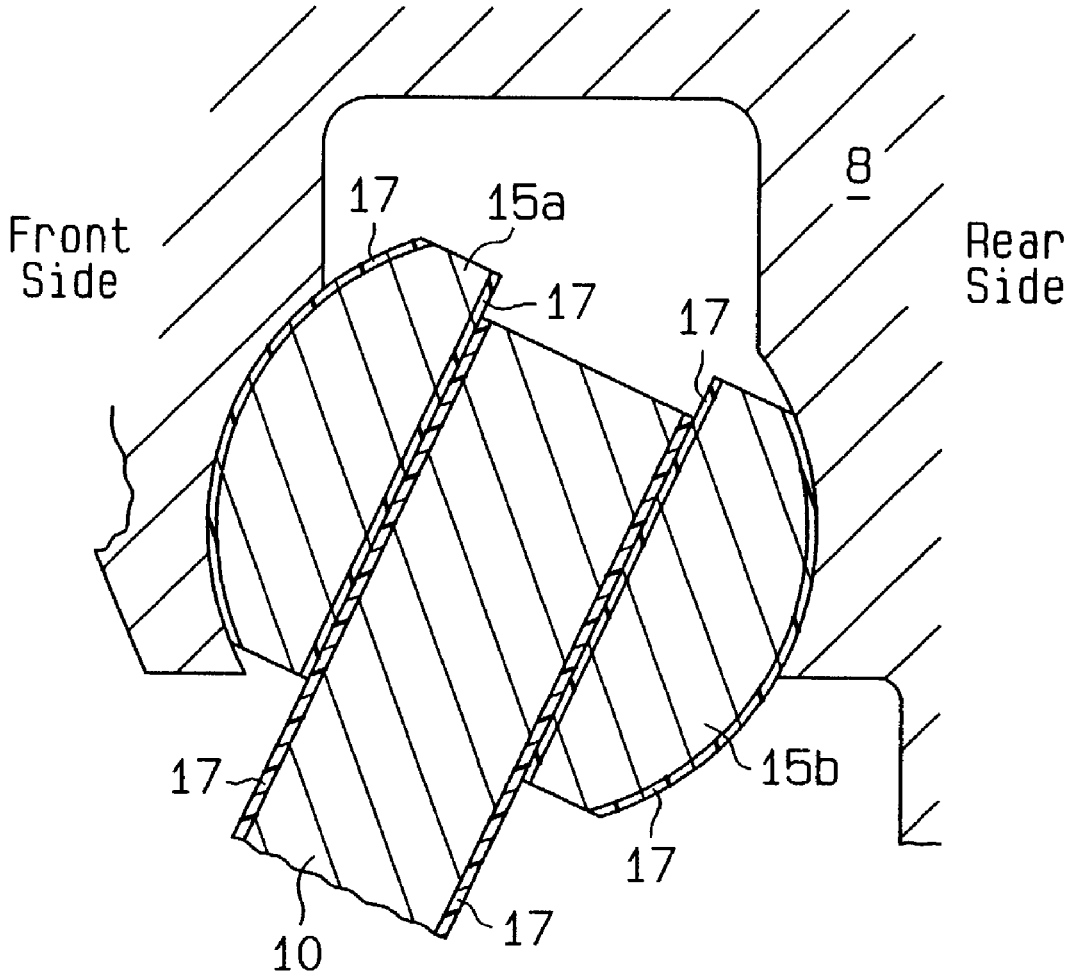
FIG. 2 is an enlarged cross-sectional view showing the relationship between the swash plate and shoes in the compressor of FIG. 1.

As shown in FIG. 1, a compressor C comprises a cylinder block 1, a front housing member 2 joined to a front end of the cylinder block 1, and a rear housing member 4 joined through a valve plate assembly 3 to a rear end of the cylinder block 1. The cylinder block 1, the valve plate assembly 3, and both housing members 2 and 4 are mutually joined and fixed by a plurality of through-bolts (not shown), thereby constituting a housing of the compressor C. A left side in FIG. 1 is a front side of the compressor C.

A crank chamber 5, a suction chamber 6, and a discharge chamber 7 are defined in the compressor housing. A plurality of cylinder bores 1*a* (only one is shown) are formed in the cylinder block 1, and a single-headed piston 8 is housed in each cylinder bore 1*a* so as to be reciprocated. The suction chamber 6 and the discharge chamber 7 are selectively communicated with each cylinder bore 1*a* through suction and discharge valves 3*a* and 3*b*, formed in the valve plate assembly 3.

A drive shaft 9 is rotatably supported by bearings between the cylinder block 1 and the front housing member 2 in a state of penetrating the crank chamber 5. The crank chamber 5 houses a swash plate 10 as a cam plate. An insertion hole 10*a* is formed in a center of the swash plate 10, and the drive shaft 9 is inserted through the insertion hole 10*a*. A lug plate 11 as a rotary support is fixed to the drive shaft 9 so as to be rotated integrally in the crank chamber 5. The swash plate 10 is connected with the drive shaft 9 through the lug plate 11 and a hinge mechanism 12 to rotate integrally with the drive shaft 9. The swash plate 10 inclines with respect to the drive shaft 9 while axially sliding along the surface of the drive shaft 9.

The swash plate 10 has a counterweight 10*b* located at the opposite side of the drive shaft 9 from the hinge mechanism 12. A spring 13 is wound on the drive shaft 9 between the lug plate 11 and the swash plate 10. The swash plate 10 is urged toward the cylinder block 1 (i.e., in the direction of tilting angle reduction) by the spring 13. Inclination of the swash plate 10 in the tilting angle reducing direction is limited by its contact with a circlip 14, and a limitation is placed on a minimum tilting angle θmin of the swash plate 10. A maximum tilting angle θmax of the swash plate 10 is limited by the contact of the counterweight portion 10*b* of the wash plate 10 with the lug plate 11. An inclination angle refers to an angle between a surface orthogonal to the drive shaft 9 and the swash plate 10.

A peripheral portion of the swash plate 10 is slidably retained at an end part of each piston 8 through a pair of front and rear shoes 15*a* and 15*b*. Accordingly, all the pistons 8 are connected to the swash plate 10. Rotational motion of the swash plate 10 following rotation of the drive shaft 9 is converted into a reciprocating motion of the piston through the shoes 15*a* and 15*b*.

The rear housing member 4 includes a conventional control valve 16 provided to regulate a crank pressure Pc. The control valve 16 is provided in the midway of an air supply passage, not shown, for communicating the crank chamber 5 with the discharge chamber 7. The control valve 16 includes a valve mechanism for controlling the opening of the air supply passage by an electromagnetic force of a solenoid. The crank pressure Pc is regulated based on the balance between the amount of supplying refrigerant gas from the discharge chamber 7 through the control valve 16 to the crank chamber 5 and the amount of releasing refrigerant gas from the crank chamber 5 to the suction chamber 6 through a bleed passage, not shown, for communicating the crank chamber 5 with the suction chamber 6.

A thermoplastic polyimide coating 17 is formed at least on sliding surfaces of the swash plate 10 and the shoes 15*a* and 15*b* as sliding components of the compressor. The thermoplastic polyimide coating 17 is formed directly on the sliding surfaces of the swash plate 10 and the shoes 15*a* and 15*b* as component main bodies. The thermoplastic polyimide coating 17 may contain solid lubricant. As the solid lubricant, for example, polytetrafluoroethylene (PTFE) is used.

For the swash plate 10, a relatively heavy iron-based material (e.g., cast iron of FCD 700 or the like) is used for properly generating moment of a rotational motion based on a centrifugal force during rotation of the swash plate 10. Likewise, for the shoes 15*a* and 15*b*, iron-based materials (e.g., bearing steel) are used with consideration given to mechanical strength and the like thereof.

When the thermoplastic polymide coating 17 is formed on the swash plate 10, first, thermoplastic polymide powder is adhered on the sliding surface (surface slice-contacting the shoes 15*a* and 15*b* of the swash plate 10 by electrostatic powder coating. As the thermoplastic polymide, AURUM PL450C (trade name) natural grade manufactured by Mitsui Chemicals, Inc. was used. The AURUM PL450C has Tg set at 250° C., and a melting point set at 388° C.

As the thermoplastic polyimide powder, for example, powder having an average particle size of 50 to 100 μm is used. By carrying out electrostatic powder coating at room temperature, a uniform powder coating is formed on the sliding surface. Then, the swash plate 10 is baked in an electric oven. For example, a temperature is increased from 400° C. to 450° C. for 30 minutes, and the swash plate 10 is held at 450° C. for 15 minutes. During this period, the thermoplastic polyimide power is melted. Then, the swash plate 10 is taken out of the electric oven, and quenched by water. The quenched thermoplastic polyimide coating 17 becomes substantially amorphous, having a smooth surface. The thermoplastic polyimide coating is firmly adhered to the surface of the swash plate 10. Annealing is carried out for the purpose of removing residual stress. The annealing is executed, for example at 230° C. for 2 hours. In addition, crystalline annealing can also be carried out. In order to contain the solid lubricant in the thermoplastic polyimide coating 17, electrostatic powder coating is carried out by mixing the thermoplastic polyimide powder with solid lubricant powder.

In order to compare sliding performance of the thermoplastic polyimide coating 17 with that of the conventional art, sliding tests were carried out for cast-iron disks equal in size to the swash plate 10, each of which was coated with thermoplastic polyimide, or thermoplastic polyimide+ PTFE, or plated with NiPB and the like. To smooth the surface, comparison was made with polished one to achieve surface roughness of Rz<3 μm.

Assuming baking in a dry state (with no lubricant), the sliding tests were carried out by rotating a disk having a coating formed at a peripheral speed of 10.4 m/s, and pressing a disk having a diameter 10 mm, made by SUJ 2 with a force of 1960 N. Under this condition, time until both disks were seized and locked was measured. The result is shown in Table 1.

TABLE 1

| | Coating material | Time until seizing (sec.) |
|---|---|---|
| Example 1 | Thermoplastic polyimide | 150 |
| Example 2 | Thermoplastic polyimide + PTFE | 780 |
| Example 3 | NiPB plating | 20 |
| Example 4 | Ni + Sn plating | 60 |
| Example 5 | PTFE + PAI | 40 |

* PAI: Polyamide-imide

As shown in Table 1, it was verified that in the case of a disk with a thermoplastic polyimide coating according to the example 1, time until seizing was longer compared with the comparative examples 1 to 3 of the prior art, and high performance was exhibited as a sliding component of the compressor. In the case of a disk with a thermoplastic polyimide coating containing PTFE according to the example 2, it was confirmed that a sliding characteristic was greatly improved compared with the coating containing only thermoplastic polyimide.

Next, description will be made of an operation of the compressor constructed in the foregoing manner.

When the drive shaft 9 is rotated, the swash plate 10 is integrally rotated. This rotational motion of the swash plate 10 is converted into a reciprocating motion of each piston 8 through the shoes 15*a* and 15*b*. Each piston 8 is then reciprocated by a stroke corresponding to a tilting angle of the swash plate 10. This driving is continued and, accordingly, in each cylinder bore 1*a*, suction of refrigerant gas from the suction chamber 6, compression of the drawn refrigerant gas, and discharging of the compressed refrigerant gas to the discharge chamber 7 are sequentially repeated. The refrigerant supplied from an unillustrated external refrigerant circuit to the suction chamber 6 is sucked through a suction port into the cylinder bore 1*a*, subjected to compression by a movement of the piston 8, and discharged through a discharge port to the discharge chamber 7. The refrigerant discharged to the discharge chamber 7 is sent out through a discharge hole to the external refrigerant circuit.

Then, an opening of the control valve 16 is adjusted according to a cooling load, and a communication state between the discharge chamber 7 and the crank chamber 5 is changed. In a state where a cooling load is high, and the pressure of the suction chamber 6 is high, an opening of the control valve 16 becomes small, and a pressure (crank pressure Pc) of the crank chamber 5 becomes small, increasing a tilting angle of the swash plate 10. Then, a stroke of the piston 8 is increased to run the compressor by a large displacement. In a state where a cooling load is low, and the pressure of the suction chamber 6 is low, an opening of the control valve 16 becomes large, and a crank pressure Pc becomes large, reducing a tilting angle of the swash plate 10. Then, a stroke of the piston 8 is reduced to run the compressor by a small displacement.

The embodiment has the following advantages.

(1) The thermoplastic polyimide coating 17 having high heat resistance, mechanical strength and chemical resistance is formed on the sliding surfaces of the swash plate 10, and the shoes 15*a* and 15*b* as the sliding components. Accordingly, sliding characteristics and durability of the swash plate 10 and the shoes 15*a* and 15*b* are improved, and it is not necessary to form any metal-binding layers between the thermoplastic polyimide coating 17 and the metallic component main body. Therefore, manufacturing is facilitated. Moreover, all the sliding components are not made of thermoplastic polyimide, but the thermoplastic polyimide coating 17 is formed on the sliding surface of the metallic component main body. Therefore, it is possible to secure necessary strength even on the sliding surface of, for example the swash plate 10, on which a large load is applied through the shoes 15*a* and 15*b*.

(2) Since the thermoplastic polyimide coating 17 contains PTFE as the solid lubricant, its friction coefficient is lower compared with the thermoplastic polyimide coating 17 containing no solid lubricant. Therefore, the sliding characteristic is improved more.

(3) The lubricity and durability of the swash plate 10 placed in a very severe sliding environment are improved. Thus, reliability and durability of the compressor is improved.

(4) The thermoplastic polyimide coating 17 is formed by the electrostatic powder coating method. Thus, it is easier to smooth the surface of the thermoplastic polyimide coating 17 having large adhesion strength to the component main body compared with a coating formed by spraying.

The present invention is not limited to the foregoing embodiment. For example, the following arrangements can be made.

The invention may be applied to the sliding components other than the swash plate 10 and the shoes 15*a* and 15*b*, such as the piston 8 and the lug plate 11. In the case of the piston 8, a thermoplastic polyimide coating 17 is formed on its surface slide-contacting the cylinder block 1 or the front housing member 2, and the shoes 15*a* and 15*b*.

The thermoplastic polyimide coating 17 needs to be formed at least on the sliding surface of the sliding components. Instead of its formation only on the sliding surface, a thermoplastic polyimide coating 17 may be formed on a portion other than the sliding surface.

The solid lubricant is not limited to PTFE, and perfluoroalkoxyethylene (PFA), molybdenum disulfide ($MoS_2$), graphite, or the like may be used. Instead of containing one type of solid lubricant, plural types of solid lubricant may be contained.

The material of the swash plate 10 is not limited to the iron-based metal, and an aluminum-based metal (aluminum or aluminum alloy), stainless steel, or the like may be used.

The invention is not limited to the swash plate compressor of a variable displacement type. It may be applied to a swash plate compressor of a double-head type or a fixed displacement type. The invention may be applied to a swash plate compressor of a type, where a swash plate is not rotated integrally with a drive shaft, but swung following the rotation of the drive shaft. Moreover, the invention is not limited to the swash plate compressor. It may be applied to a compressor of other types, such as a scroll type or a vane type compressor.

The present invention may be applied sliding members of apparatuses other than compressors.

The thermoplastic polyimide coating 17 may be formed by a method other than electrostatic powder coating. For example, the thermoplastic polyimide coating 17 may be formed by spraying. When partially forming an annular thermoplastic polyimide coating in the cylinder bore in an engine, the coating is formed more easily by spraying.

Therefore, the present examples and embodiments are to be considered as illustrative and not restrictive and the invention is not to be limited to the details given herein, but may be modified within the scope and equivalence of the appended claims.

The invention claimed is:

1. A system of sliding components used in a compressor, comprising:

a shoe formed from metal having a first sliding surface;

a swash plate having a second sliding surface; and a thermoplastic polyimide coating formed on the first and second sliding surfaces, the thermoplastic polyimide forming the coating having a Tg set at 250° C. and a melting point set at 388° C., wherein the thermoplastic polyimide is not polyamidimide.

2. The sliding component according to claim 1, wherein the thermoplastic polyimide coating contains solid lubricant.

3. The sliding component according to claim 2, wherein the solid lubricant is polytetrafluoroethylene.

4. The sliding component according to claim 1, wherein the thermoplastic polyimide coating is formed through electrostatic powder coating.

5. The sliding component according to claim 1, wherein the thermoplastic polyimide coating is formed through spraying.

6. A compressor comprising:

a drive shaft;

a swash plate supported on the drive shaft, wherein the swash plate has a first sliding surface;

a shoe formed from metal, wherein the shoe has a second sliding surface sliding on the first sliding surface;

a piston coupled to the swash plate with the shoe, wherein the swash plate converts rotation of the drive shaft into reciprocation of the piston, wherein the shoe has a third sliding surface, which slides on the piston, wherein the piston has a fourth sliding surface, which slides on the third sliding surface; and a thermoplastic polyimide coating formed on at least two of the first to fourth sliding surfaces, the thermoplastic polyimide forming the coating having a Tg set at 250° C. and a melting point set at 388° C., wherein the thermoplastic polyimide is not polyamidimide.

7. The compressor according to claim 6, wherein the thermoplastic polyimide coating contains solid lubricant.

8. The compressor according to claim 7, wherein the solid lubricant is polytetrafluoroethylene.

* * * * *